US005577923A

United States Patent [19]

Lee

[11] Patent Number: 5,577,923

[45] Date of Patent: Nov. 26, 1996

[54] 125V/250V SAFETY ELECTRIC SOCKET DEVICES

[76] Inventor: Chiu-Shan Lee, No. 4, Alley 14, Lane 53, Hung-Tao St., Hsi-Chih Town, Taipei County, Taiwan

[21] Appl. No.: 354,254

[22] Filed: Dec. 12, 1994

[51] Int. Cl.[6] ..... H01R 29/00

[52] U.S. Cl. ..... 439/170; 439/342; 439/518; 439/956

[58] Field of Search ..... 439/166, 170, 439/171, 172, 218, 221, 222, 956, 342, 518

[56] References Cited

U.S. PATENT DOCUMENTS

| | | | |
|---|---|---|---|
| 3,120,985 | 2/1964 | Hubbell | 439/166 |
| 4,518,212 | 5/1985 | Rumble | 439/166 |
| 4,911,649 | 3/1990 | Helmich, Jr. | 439/170 |
| 5,007,848 | 4/1991 | Lee | 439/101 |

*Primary Examiner*—Neil Abrams
*Assistant Examiner*—Eugene G. Byrd
*Attorney, Agent, or Firm*—Morton J. Rosenberg; David I. Klein

[57] ABSTRACT

A 125 V/250 V safety electric socket device, including a socket body having a set of L pole contact metal plates and a set of N pole contact metal plates respectively connected to 125 V and 250 V power sources, a non-fuse circuit breaker contact metal rod, L-shaped rails defining a crossed sliding way; a cover panel covered on the socket body, having a rectangular center opening, two guide slots respectively extended from the center opening leftward and downwards, and a circuit breaker slot, which receives the non-fuse circuit breaker contact metal rod; a slide moved in the crossed sliding way and marked with a 125 V directional arrow and a 250 V directional arrow, and having two sets of bottom contacts for connection to 125 V and 250 V power sources respectively; a first plug panel and a second plug panel respectively detachably connected to the slide at right angles; wherein when the slide is moved in the direction of the 250 V directional arrow, one set of bottom contacts of the slide are respectively electrically connected to 250 V contact metal plates, permitting 250 V power source to be electrically connected to the socket body, and at the same time said first plug panel is moved into the operative position aligned with the center opening on the cover panel for receiving a 250 V electric plug; when the slide is moved in the direction of the 125 V directional arrow to carry the second plug panel into the operative position aimed at the center opening on the cover panel for receiving a 125 V electric plug, respective bottom contacts of the slide are electrically connected to 125 V contact metal plates, permitting 125 V power source to be electrically connected to the socket body.

6 Claims, 16 Drawing Sheets

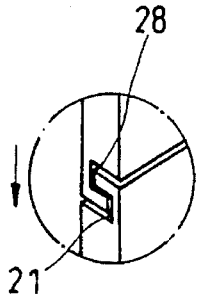
FIG.4A
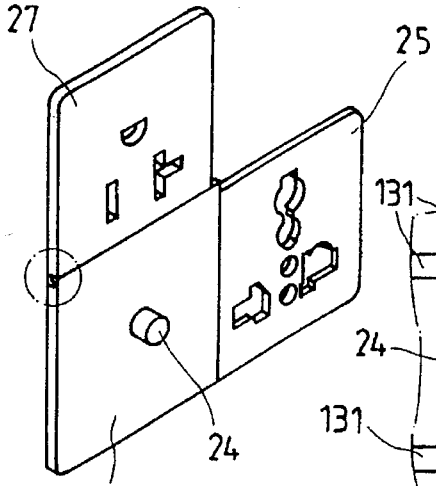
FIG.4
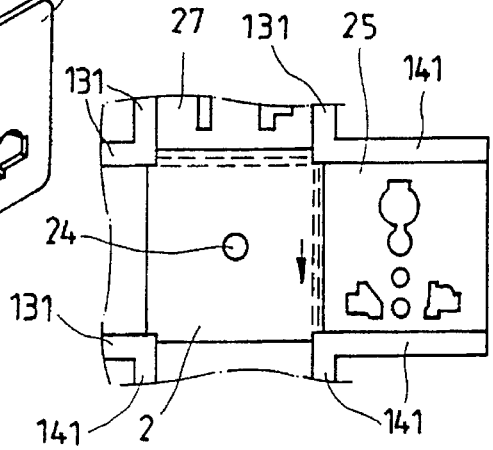
FIG.4B
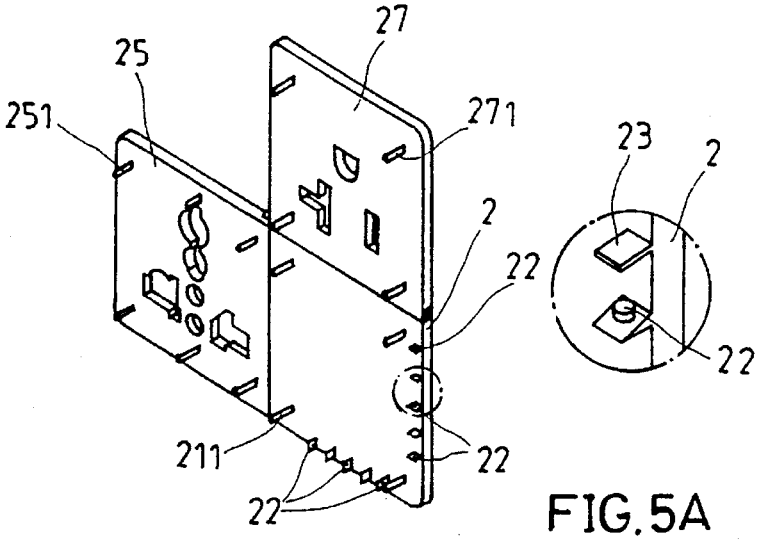
FIG.5A
FIG.5

125V/250V SAFETY ELECTRIC SOCKET DEVICES

BACKGROUND OF THE INVENTION

The present invention relates to 125 V/250 V safety electric socket devices derivated from U.S. Pat. No. 5,007,848 which can be alternatively controlled to receive a 125 V electric plug or a 250 V electric plug and, which automatically breaks the circuit when the electric plug is disconnected.

Various electric sockets have been disclosed, and have appeared on the market. However, these electric sockets are commonly designed for power source of a specific specification. For example, a 125 V electric socket can only be used for power source of 125 V; a 250 V electric socket can only used for power source of 250 V. Therefore, different electric sockets must be prepared for power source of different voltages.

SUMMARY OF THE INVENTION

The present invention has been accomplished under the circumstances in view. It is one object of the present invention to provide a safety electric socket which is electrically connected only when the electric plug is completely inserted into position. It is another object of the present invention to provide a safety electric socket which is electrically disconnected when the electric plug is removed. It is still another object of the present invention to provide a safety electric socket which is suitable for the connection of any of a variety of electric plugs of different specifications. It is still another object of the present invention to provide a safety electric socket which can be alternatively arranged to accept a 125 V or 250 V electric plug. It is still another object of the present invention to provide a safety electric outlet strip which can be arranged to receive 125 V electric plugs only or 250 V electric plugs only.

According to one embodiment of the present invention, a 25 V/250 V safety electric socket device comprises a socket body having a set of L pole contact metal plates and a set of N pole contact metal plates respectively connected to 125 V and 250 V power sources, a non-fuse circuit breaker contact metal rod, L-shaped rails defining a crossed sliding way; a cover panel covered on the socket body, having a rectangular center opening, two guide slots respectively extended from the center opening leftward and downwards, and a circuit breaker slot, which receives the non-fuse circuit breaker contact metal rod; a slide moved in the crossed sliding way and marked with a 125 V directional arrow and a 250 V directional arrow, and having two sets of bottom contacts for connection to 125 V and 250 V power sources respectively; a first plug panel and a second plug panel respectively detachably connected to the slide at right angles; wherein when the slide is moved in the direction of the 250 V directional arrow, one set of bottom contacts of the slide are respectively electrically connected to 250 V contact metal plates, permitting 250 V power source to be electrically connected to the socket body, and at the same time said first plug panel is moved into the operative position aligned with the center opening on the cover panel for receiving a 250 V electric plug; when the slide is moved in the direction of the 125 V directional arrow to carry the second plug panel into the operative position aimed at the center opening on the cover panel for receiving a 125 V electric plug, respective bottom contacts of the slide are electrically connected to 125 V contact metal plates, permitting 125 V power source to be electrically connected to the socket body.

According to another embodiment of the present invention, the socket body has guide grooves and guide rails for mounting a plug plate so that the socket body and the plug plate can be arranged into an electric adapter. The plug plate can be made in any of a variety of forms having different prongs for electric sockets of different specifications.

According to still another embodiment of the present invention, the 125 V/250 V safety electric socket is an electric outlet strip comprising a cover panel having two rows of outlets, a circuit board having 125 V and 250 V contact metal plates and being covered by the cover panel, a plug panel disposed between the cover panel and the circuit board and having an elongated toothed portion and two sets of bottom contacts, and a control knob mounted on the cover panel, a gear fixedly mounted on the control knob and meshed with the elongated toothed portion, wherein when the control knob is turned in one direction to move the plug panel leftward, a first set of bottom contacts of the plug panel are electrically connected to the respective contact metal plates on the circuit board, causing 125 V power source connected to individual socket bodies inside the electric outlet strip, and respective plug holes on the plug panel are aligned with the outlets for the connection of 125 V electric plugs; when the control knob is turned in the reversed direction to move the plug panel rightward, a second set of bottom contacts of the plug panel are electrically connected to the respective contact metal plates on the circuit board, causing 250 V power source connected to individual socket bodies inside the outlet strip, and respective plug holes on the plug panel are aligned with the outlets for the connection of 250 V electric plugs.

BRIEF DESCRIPTION OF THE DRAWINGS

FIG. 4 shows the slide and the first and second plug panels of FIG. 1 connected together;

FIG. 4A is a partial view in section of FIG. 4, showing the connection between the slide and the second plug panel of FIG. 4;

FIG. 4B shows the second plug panel moved downwards by the slide and the first plug panel disconnected from the slide;

FIG. 5 is a back side view of FIG. 4;

FIG. 5A is a partial view in section of FIG. 5;

DETAILED DESCRIPTION OF THE PREFERRED EMBODIMENTS

Figures 1, 1A:
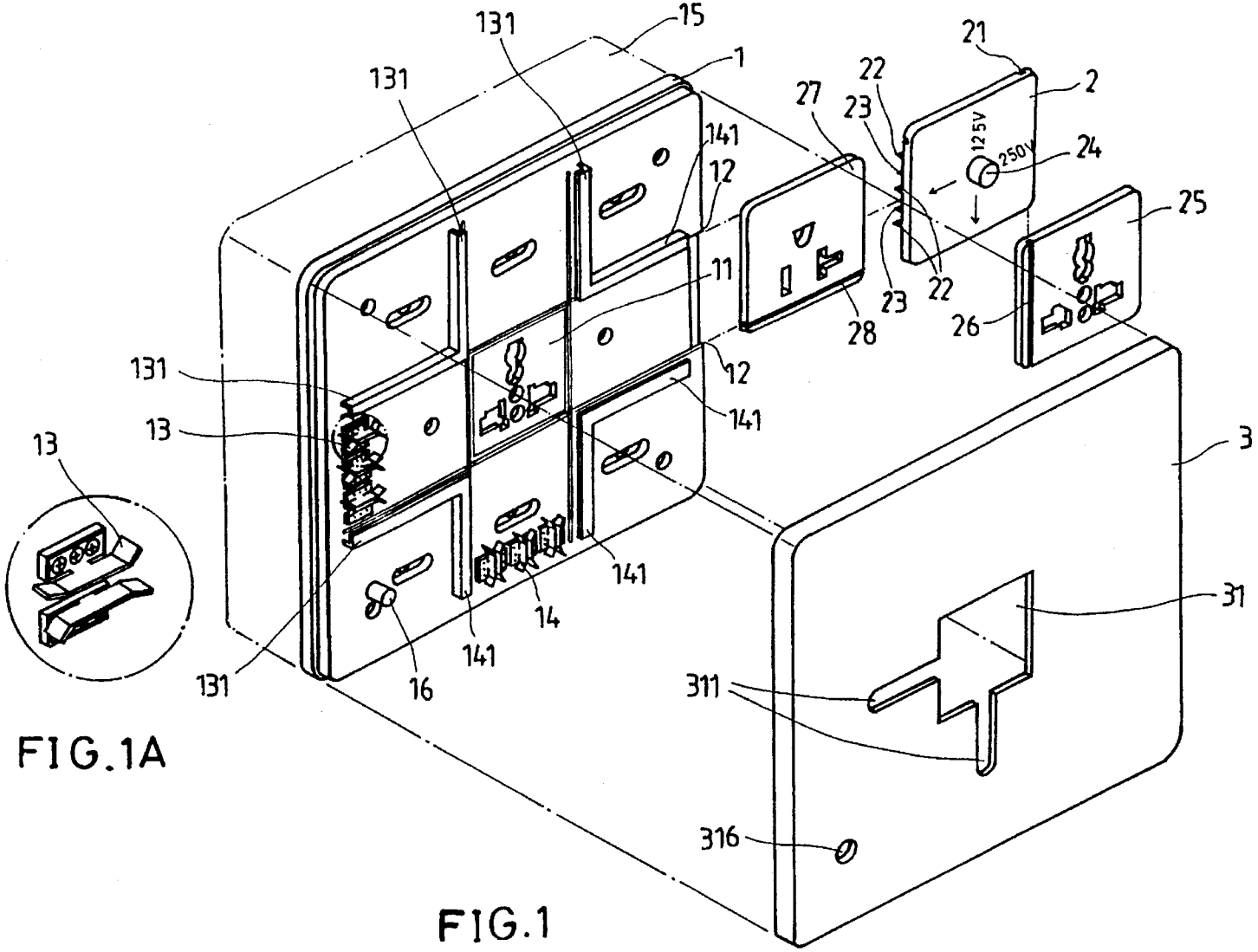
FIG. 1 is an exploded view of a 125 V/250 V safety electric socket device according to the present invention.
FIG. 1A is an exploded view of the socket body metal plate as shown in FIG. 1.
Figure 3:
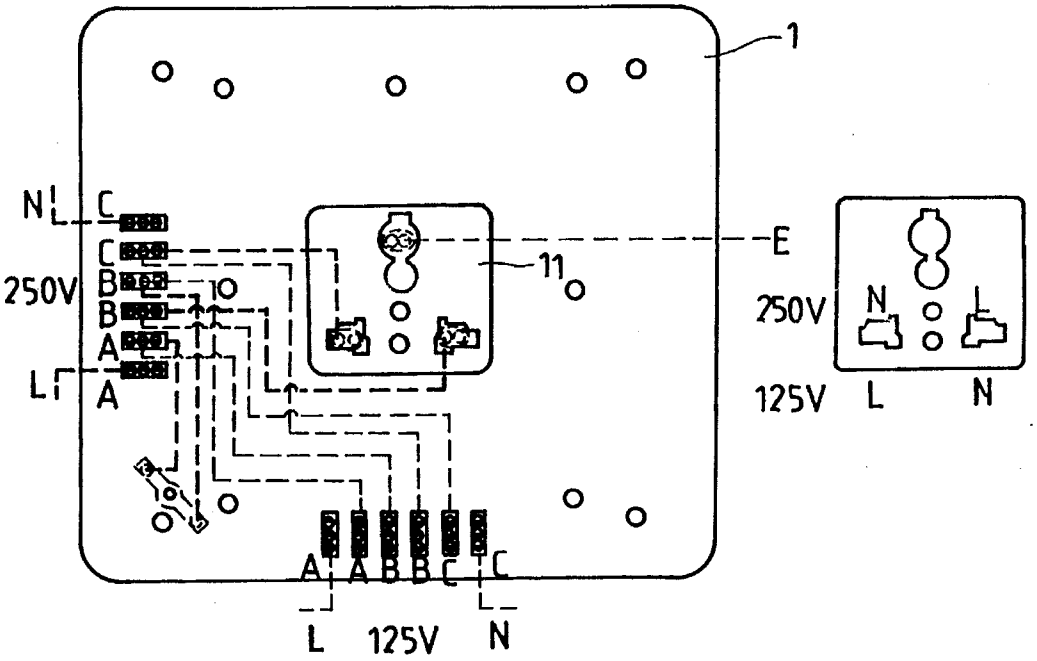
FIG. 3 is a circuit layout of the socket body of the socket device shown in FIG. 1.
Figure 2:
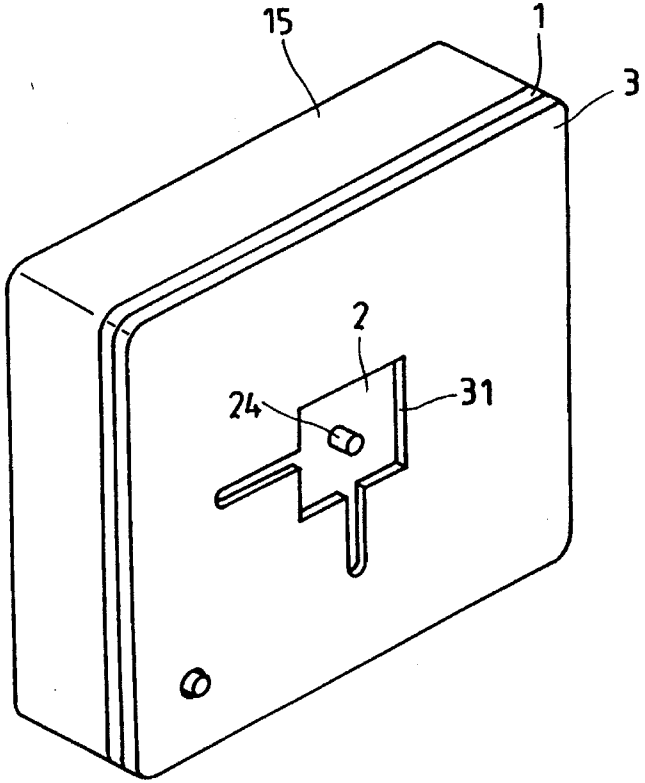
FIG. 2 is an assembly view of the socket device shown in FIG. 1.
Figure 6:
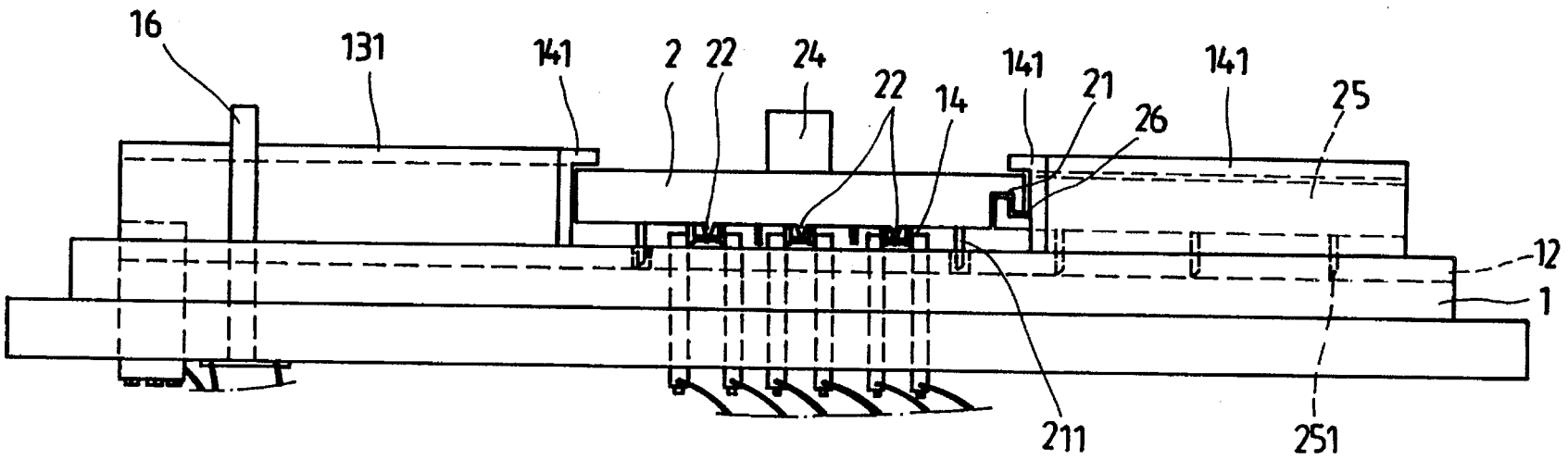
FIG. 6 is a sectional view in en enlarged scale of the socket device of FIG. 1.
Figure 7B:
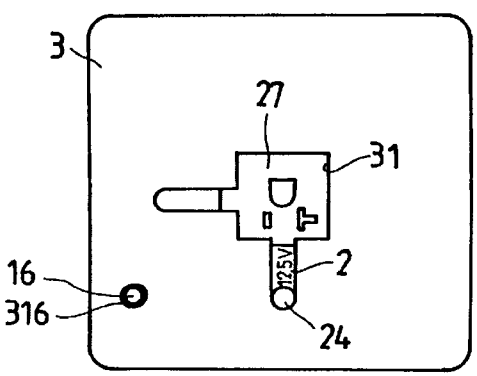
FIG. 7B shows the second plug panel aimed at the rectangular center opening of the cover panel.
Figure 7A:
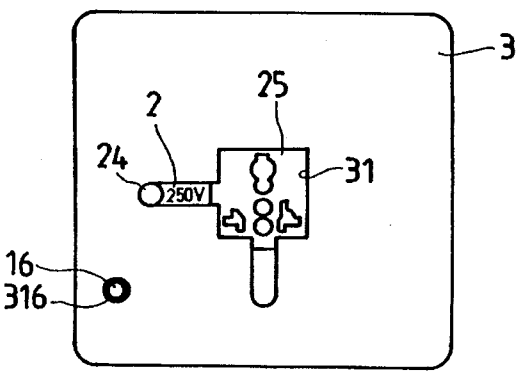
FIG. 7A shows the first plug panel aimed at the rectangular center opening of the cover panel.
Figure 7:
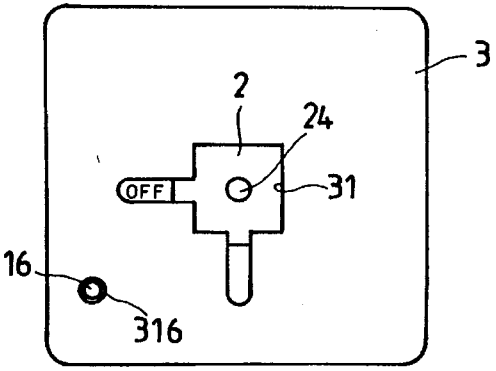
FIG. 7 shows the slide aimed at the rectangular center opening of the cover panel.
Figure 8B:
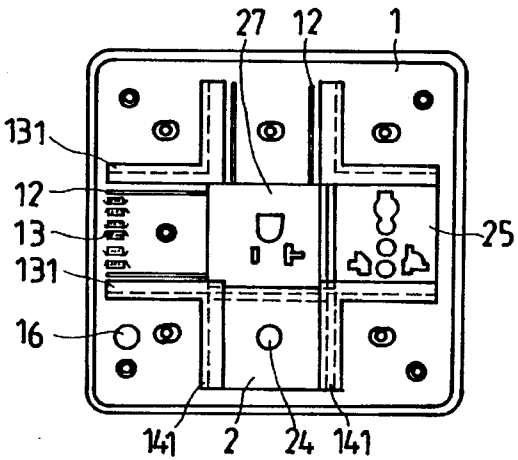
FIG. 8B is a plain view of FIG. 7B when the cover panel removed.
Figure 8A:
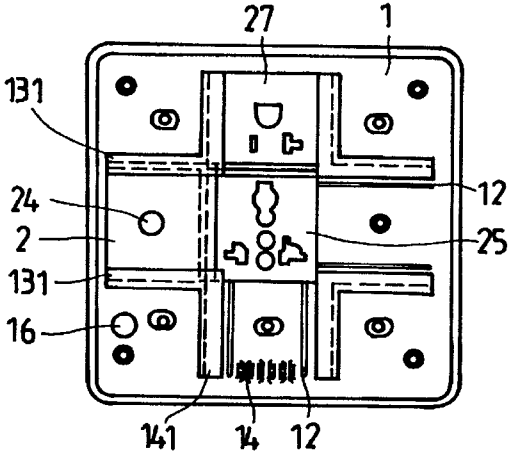
FIG. 8A is a plain view of FIG. 7A when the cover panel removed.
Figure 8:
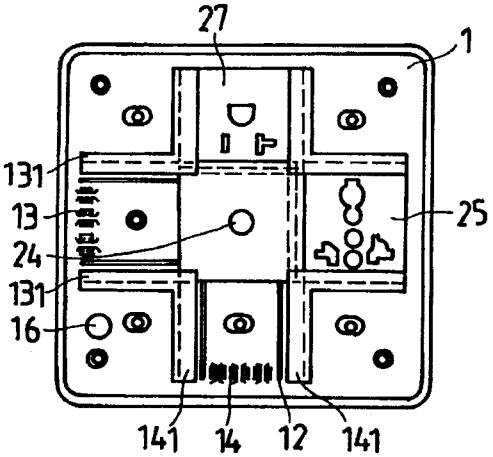
FIG. 8 is a plain view of FIG. 7 when the cover panel removed.

Referring to FIGS. 1 through 8, a 125 V/250 V electric socket device according to a first embodiment of the present invention is generally comprised of a socket body 11 fastened to a socket mount 1 mounted within a junction box 15, a cover panel 3 covered on the socket body 11, a slide 2 moved between the socket body 11 and the cover panel 3, a first plug panel 25 and a second plug panel 27 connected to the slide 2 at right angles and moved by the slide 2 between the socket body 11 and the cover panel 3. The socket body 11 has two sets of contact metal plates 13 and 14 connected to 125 V/250 V power source and ground terminals. The slide 2 is marked with 125 V and 250 V directional arrows, having a finger rod 24 for moving by hand. The cover panel 3 comprises a rectangular center opening 31, a two guide slots 311 respectively extended from the rectangular center opening 31 at right angles, and a non-fuse circuit breaker slot 316, which receives a non-fuse circuit breaker contact metal rod 16 on the socket body 11. The cover panel 3 further comprises back hooks 317 (not shown) fastened to the socket mount 1. When the slide 2 is marked with an OFF mark, when the OFF mark is shown through the rectangular opening 31 of the cover panel 3, the socket body 11 is electrically disconnected. The first plug panel 25 and the second plug panel 27 are respectively connected to the slide 2 at right angles by respective hooked portions 21, 26, and. 28. The slide 2 and the first and second plug panels 25 and 27 have respective back pins 211, 251, and 271 moved in grooves 12 on the socket mount 1 (see FIG. 5). When the slide 2 is moved in the direction of the 250 V directional arrow to the contact metal plates 13 (including the AA of L pole and CC of N pole of 250 V power source and the non-fuse breaker contact metal plates BB), respective contacts 22 of the slide 2 are respectively electrically connected to the contact metal plates 13, permitting 250 V power source electrically connected to the socket body 11, and at the same time the first plug panel 25 is moved into the operative position for receiving a 250 V electric plug. When the first plug panel 25 is moved into the operative position, it prohibits the connection of a 125 V electric plug. When to use 125 V power source, the slide 2 is moved to the OFF position to simultaneously carry the first plug panel 25 to the stand-by position, and then the slide 2 is moved in the direction of the 125 V directional arrow to carry the second plug panel 27 to the operative position aimed at the rectangular center opening 31 of the cover panel 3 (see FIGS. 7B and 8B) for receiving a 125 V electric plug, permitting 125 V power source to be electrically connected to the socket body 11. When the slide 2 is moved back to its former position, the contacts 22 are disconnected from power source, and the socket body 11 is electrically disconnected. The socket mount 1 has angle rails 131 and 141 defining a crossed passage for guiding the movement of the slide 2 and the first and second plug panels 25 and 27 smoothly (see FIG. 6).

Figure 10:
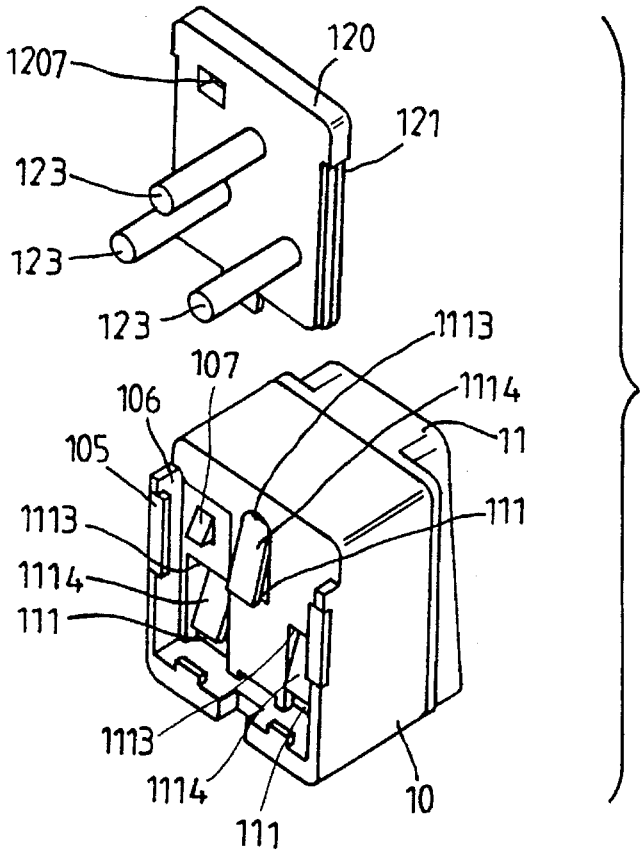
FIG. 10 is an exploded view of an adapter comprised of a socket body and a plug plate according to the present invention.
Figure 10A:
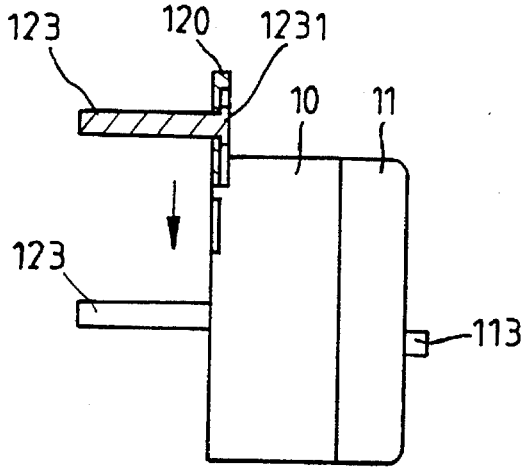
FIG. 10A is a side view of the adapter of FIG. 10, showing the plug plate fastened to the socket body.
Figure 10B:
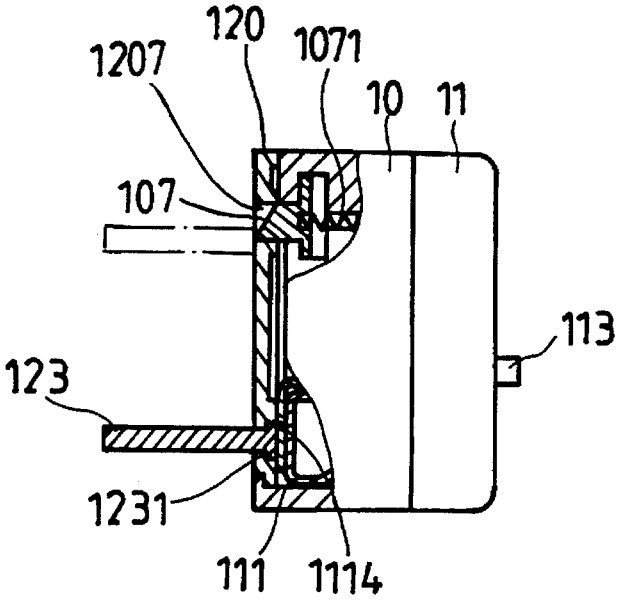
FIG. 10B is a sectional view of the adapter of FIG. 10A.
Figure 10C:
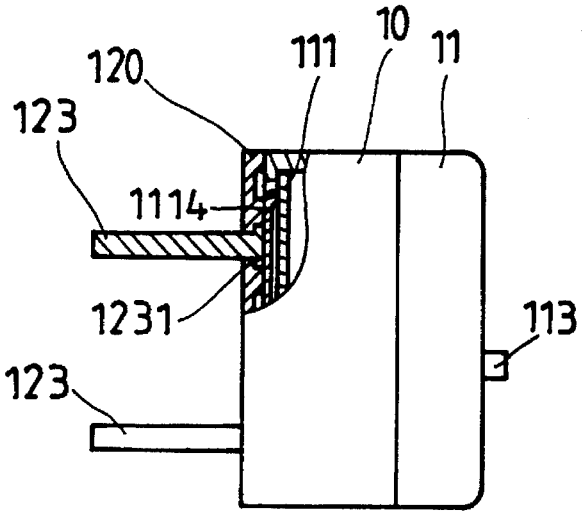
FIG. 10C shows an alternate form of the adapter of FIG. 10B.
Figure 11A:
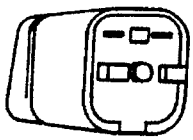
FIGS. 11 through 11U show different adapters having different plug plates according to the present invention.
Figure 11F:
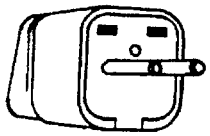
Figure 11B:
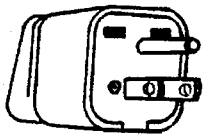
Figure 11G:
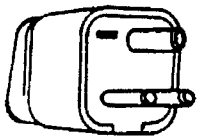
Figure 11C:
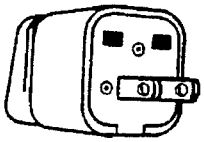
Figure 11H:
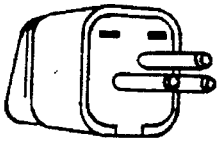
Figure 11D:
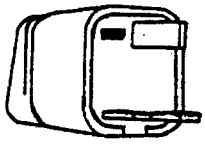
Figure 11I:
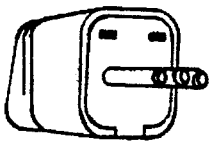
Figure 11E:
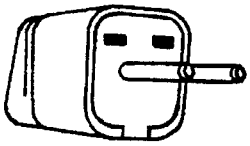
Figure 11J:
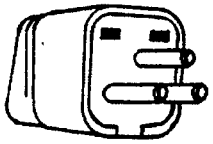
Figure 11K:
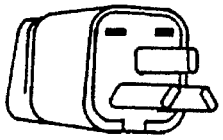
Figure 11L:
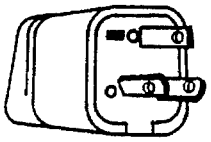
Figure 11M:
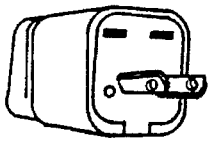
Figure 11N:
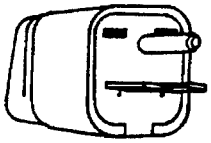
Figure 11O:
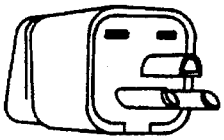
Figure 11P:
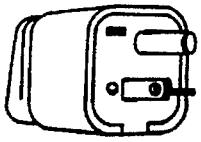
Figure 11Q:
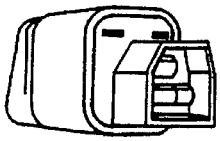
Figure 11R:
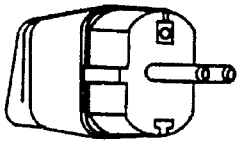
Figure 11S:
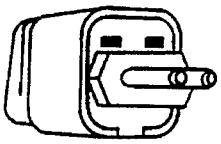
Figure 11T:
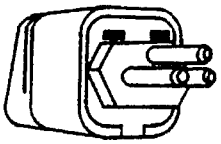
Figure 11U:
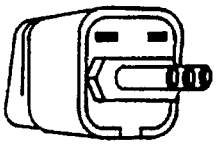

FIGS. 10 through 10C show an alternate form of the present invention in which the socket body 11 is coupled with a plug plate 120 to form an electric adapter. The base 10 of the socket body 11 comprises L-shaped guide rails 105 and guide grooves 106, a triangular retainer block 107 supported on a spring 1071, three slots 1113, three contact metal frames 111 respectively extended out of the slots 1113, tilted metal spring plates 1114 respectively riveted to the N pole and L pole and earth contact metal frames 111. The plug plate 120 comprises three prongs 123 at one side, two rails 121 at an opposite side, and a retaining hole 1207 through both sides. The rails 121 of the plug plate 120 are respectively inserted into the guide grooves 106 and engaged with the guide rails 105, and shifted vertically between two positions (see FIGS. 10A and 10B). When the plug plate 120 is moved from the position shown in FIG. 10A to the position shown in FIG. 10B, the roots 1231 of the prongs 123 are respectively connected to the metal spring plates 1114, and triangular retainer block 107 is forced into the retaining hole 1207 of the plug plate 120. By pressing down the triangular retainer block 107 to disconnect the retaining hole 12 from the triangular retainer block 107, the plug plate 120 can be removed from the socket body 11 for a replacement. FIGS. 11 through 11U show a variety of plug plates that can be alternatively coupled to the socket body 11 for use in different conditions.

Figure 9:
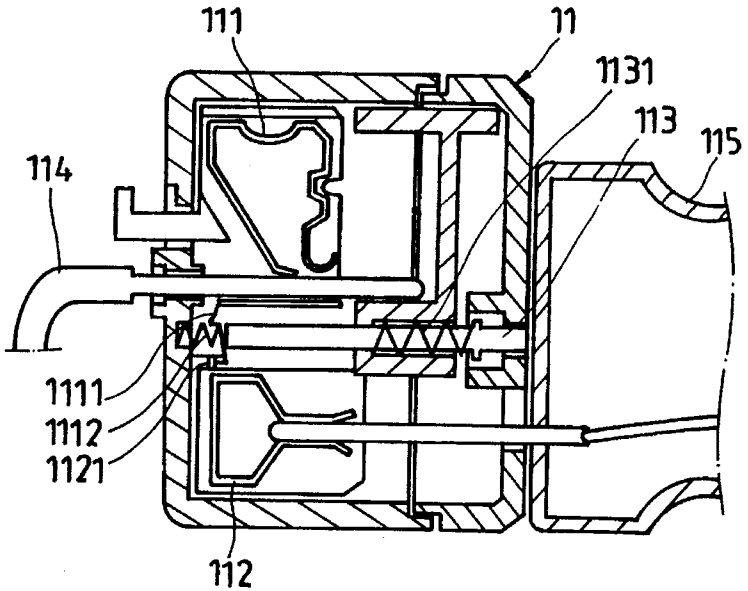
FIG. 9 shows an electric plug connected to the socket body and the circuit breaker system electrically connected.
Figure 9A:
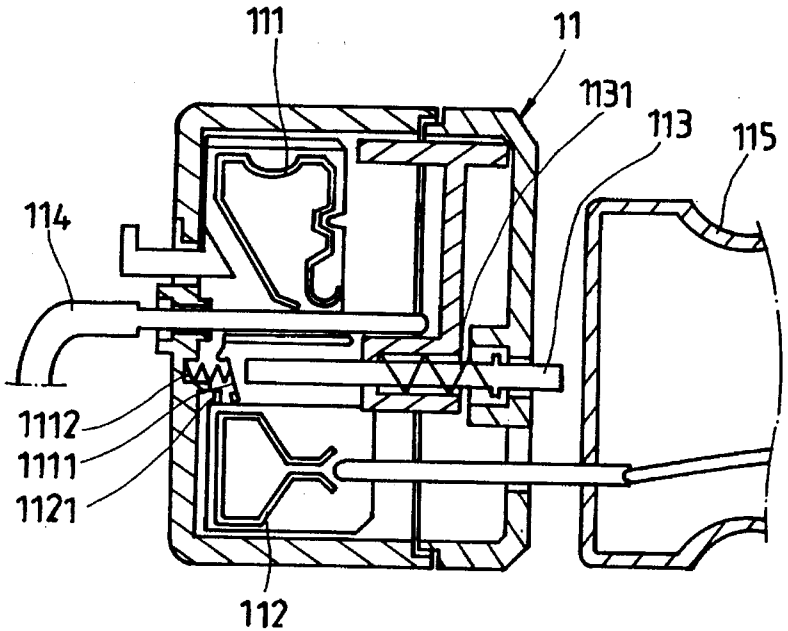
FIG. 9A is similar to FIG. 9 but showing the electric plug spaced from the sliding contact pin.

Referring to FIGS. 9 and 9A, the N or L pole of the socket body 11 is comprised of two vertically spaced contact metal frames 111 and 112 and matched with a set of contact spring plates 1111 and 1121, to form a circuit breaker system. The circuit breaker system can be operated by a microswitch for ON/OFF controls. The socket body 11 has sliding contact pin 113 supported on a spring 1131. When a plug 115 is connected to the socket body 11, the sliding contact pin 113 is forced backward to electrically connect the contact spring plates 1111 and 1121. When the plug 115 is spaced from the socket body 11 at a distance over 0.5 cm, the sliding contact pin 111 is pulled away from the contact spring plates 1111 and 1121 by the spring 1131, causing the circuit broken.

Figure 12:
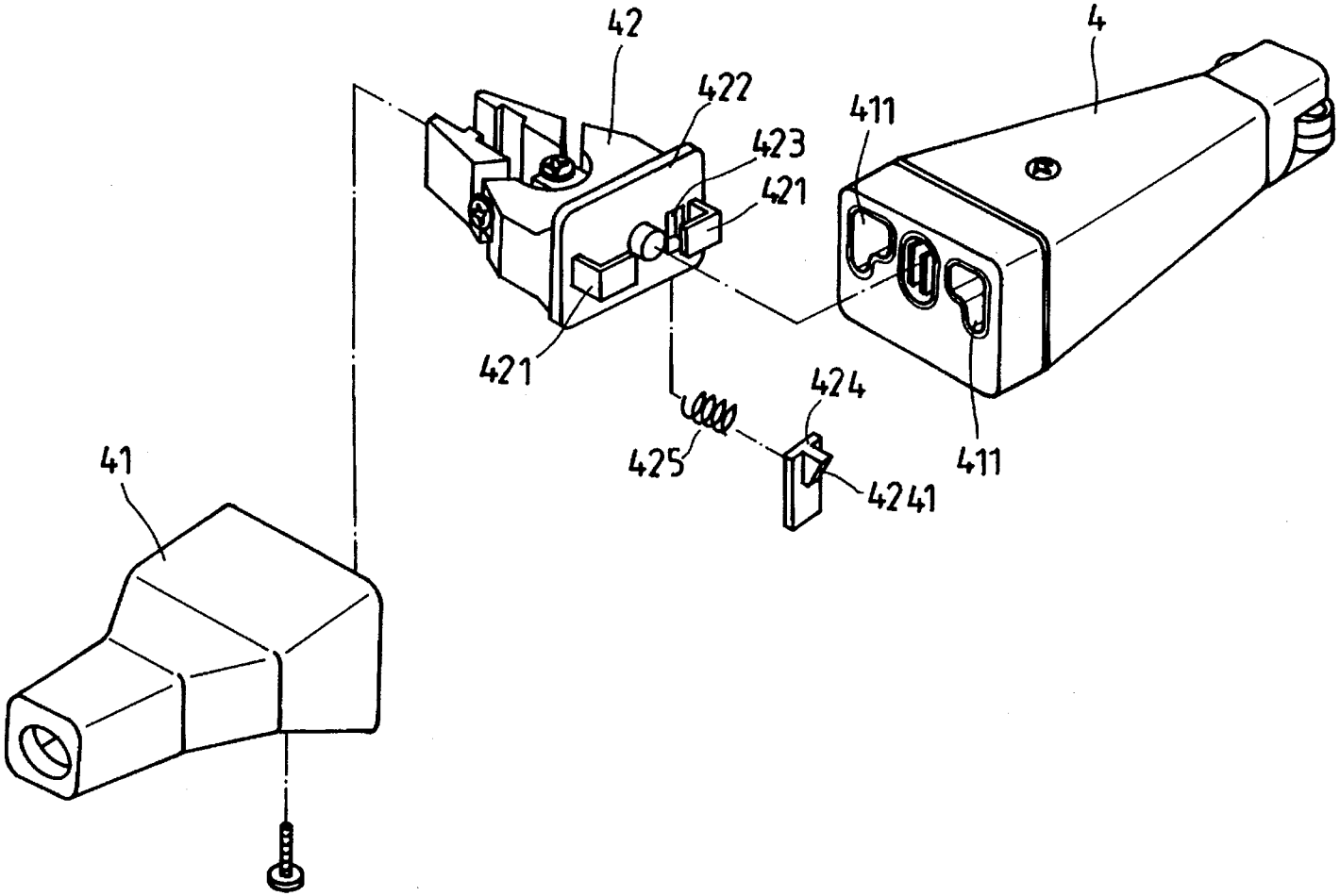
FIG. 12 is an exploded view of an electric plug and an electric socket according to the present invention.
Figure 12A:
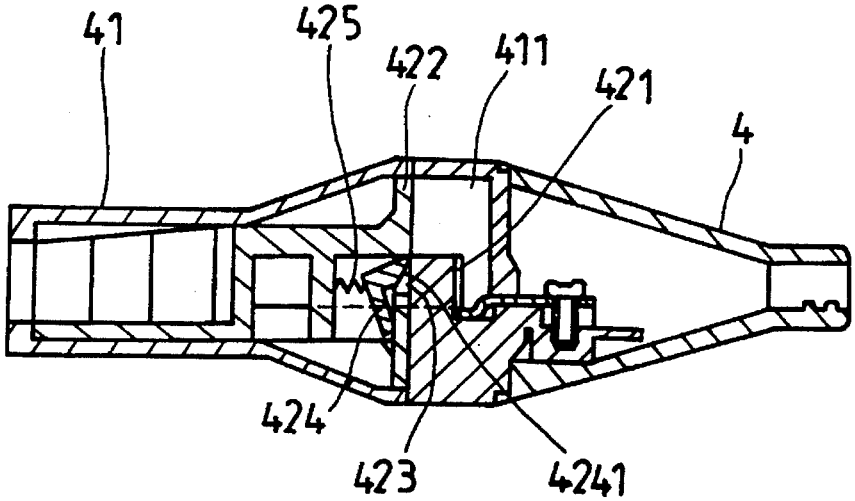
FIG. 12A shows the electric plug and electric socket of FIG. 12 connected in the correction direction.
Figure 12B:
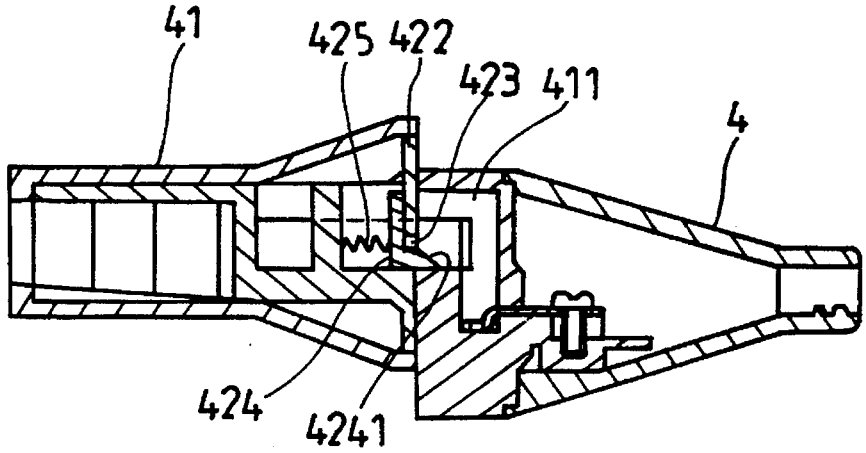
FIG. 12B shows the electric plug and electric socket of FIG. 12 connected in the wrong direction.

Referring to FIGS. 12, 12A, and 12B, the plug body 42 is covered within a plug casing 41 and connected to a socket 4. The socket 4 has two plug holes 411. The plug body 42 comprises a front panel 422, two angle prongs 421 raised from the front panel 422 for inserting into the plug holes 411 on the socket 4, a square slot 423 on the front panel 422, a control block 424 received in the square slot 423 and supported on a spring 425. The control block 424 has a beveled projection 4241 protruding the square slot 423. When the angle prongs 421 are inserted into the plug holes 411 in the correct direction, the beveled projection 4241 of the control block 424 is forced back inside the square slot 423 (see FIG. 12A). If the poles of the angle prongs 421 are not in match with the poles of the plug holes 411, the beveled projection 4241 Will be jammed in one plug hole 411 to prohibit an electric contact between the plug body 42 and the socket 4.

Figure 13:
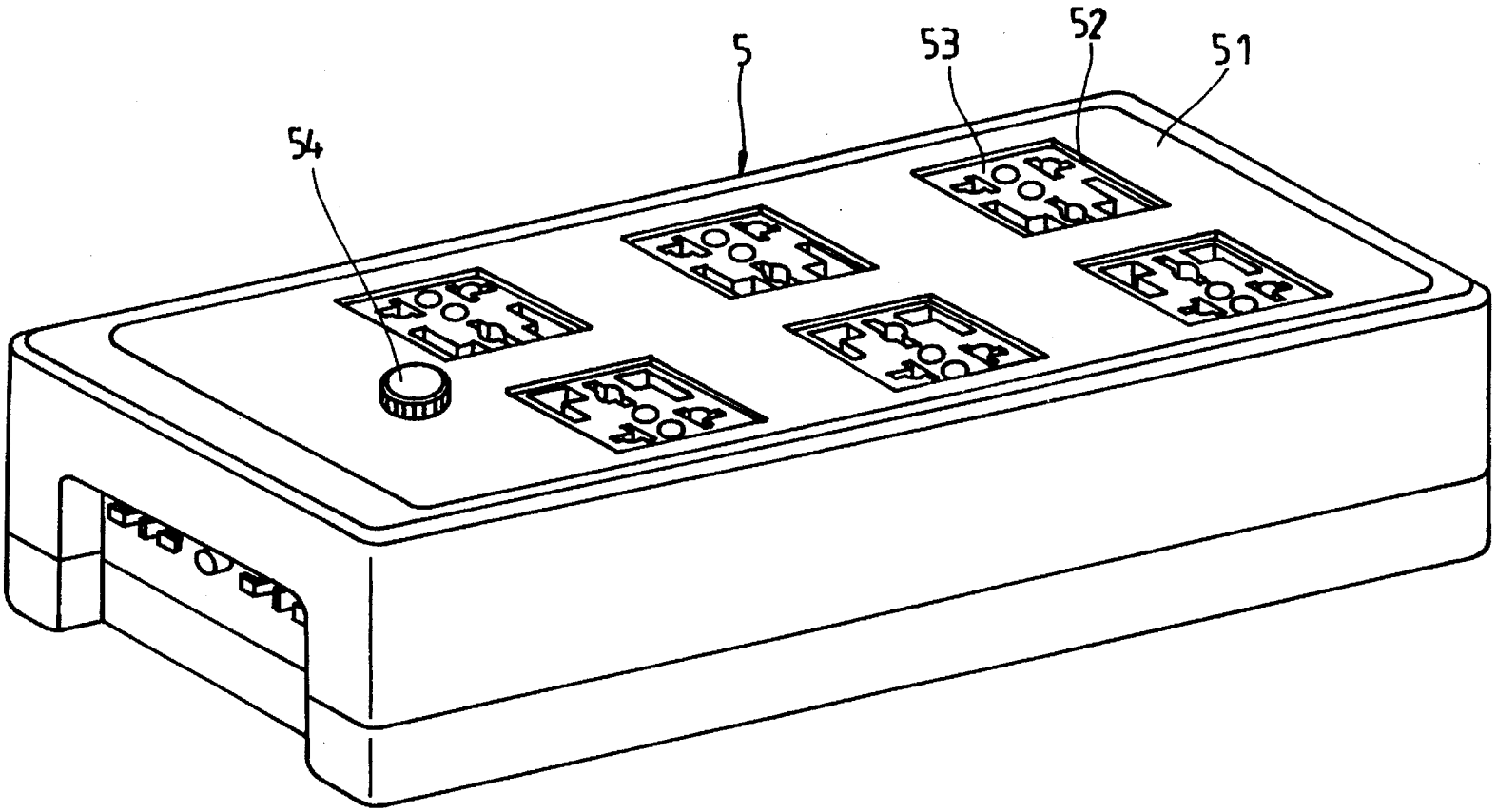
FIG. 13 shows an electric outlet strip according to the present invention.
Figure 14:
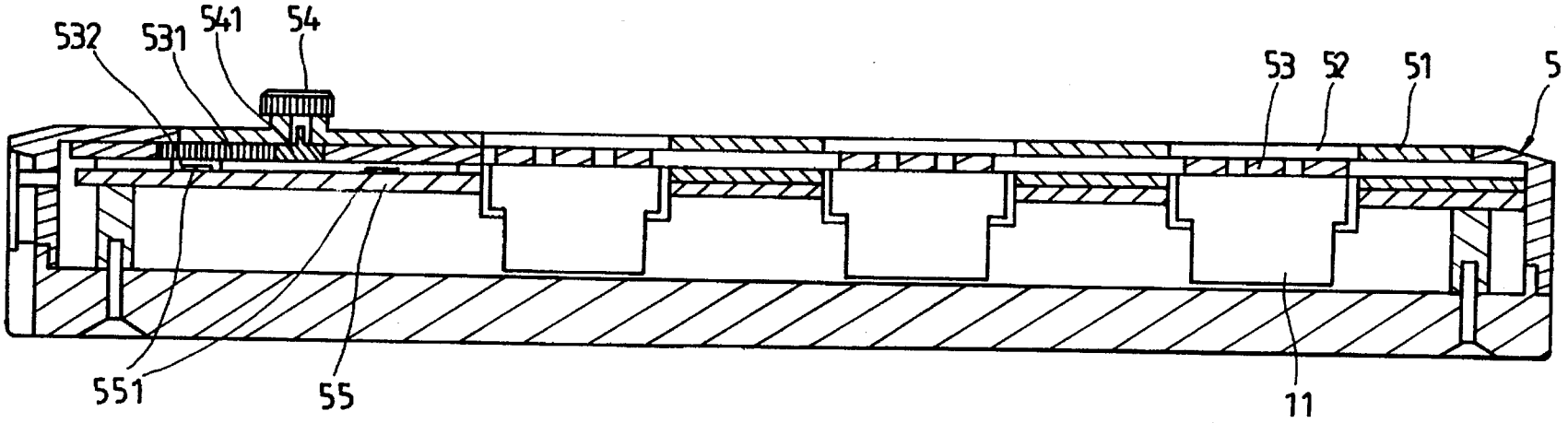
FIG. 14 is a longitudinal view in section of the electric outlet strip of FIG. 13.
Figure 15:
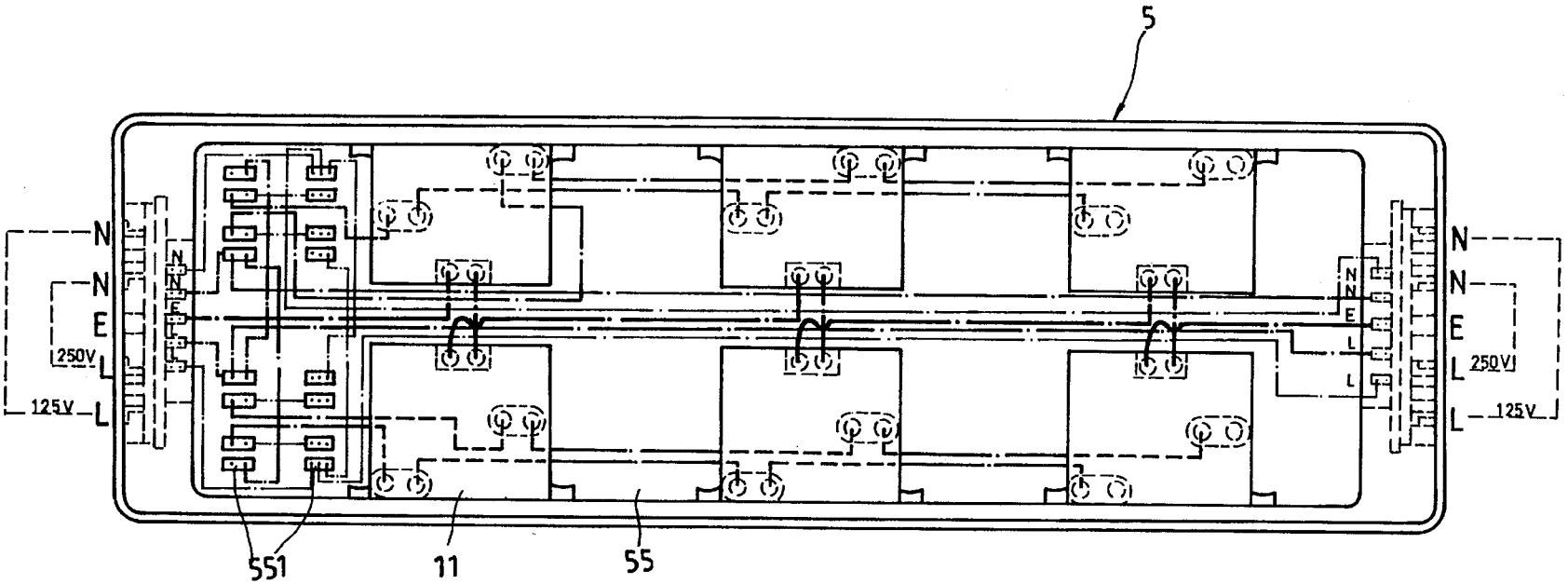
FIG. 15 is a top plain view of the electric outlet strip of FIG. 13.

Referring to FIGS. 13, 14, and 15, the outlet strip, referenced by 5, comprises a cover panel 51 having two rows of outlets 52, a circuit board 53 with 250 V and 125 V contact metal plates 551 covered by the cover panel 51, a plug panel 53 disposed between the cover panel 51 and the circuit board 53, and a control knob 54 mounted on the cover panel 51 and turned to rotate a gear 541. The plug panel 53 has an elongated toothed portion 531 meshed with the gear 541. When the plug panel 53 is moved leftward or rightward by turning the control knob 54. When the control knob 54 is turned to move the plug panel 53 leftward or rightward, the bottom contacts 532 of the plug panel 53 are electrically connected to the respective contact metal plates 551, causing 125 V or 250 V power source connected to the individual socket bodies 11 inside the outlet strip 5, and the corresponding plug holes (not shown) on the plug panel 53 are aligned with the outlets 52 for the connection of 125 V or 250 V electric plugs. Therefore, this arrangement allows only one single voltage to be electrically connected to the circuit.

Figure 16:
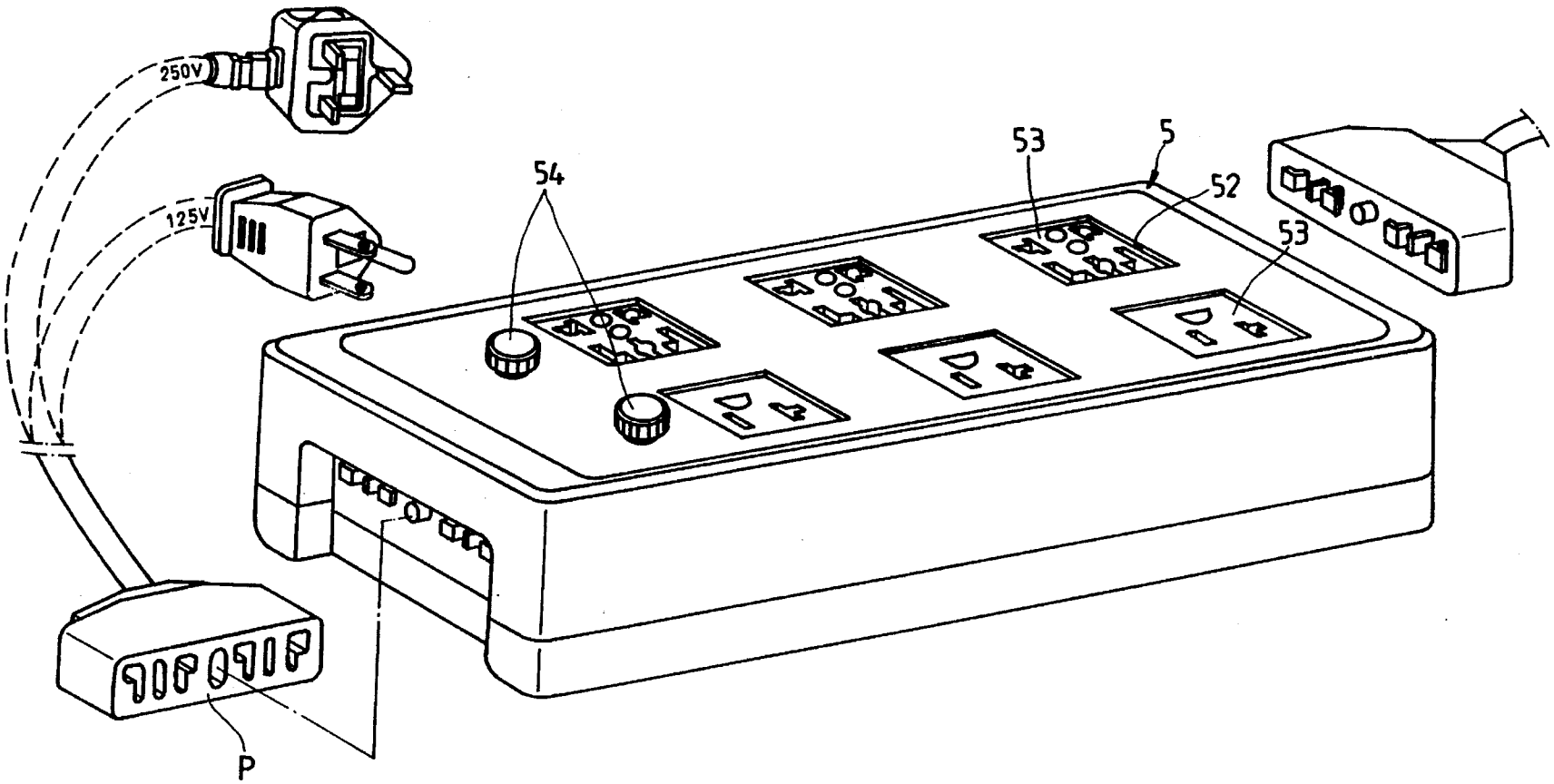
FIG. 16 shows an alternate form of the electric outlet strip according to the present invention.

FIG. 16 shows an alternate form of the outlet strip 5, in which the plug panel 53 is comprised of two halves controlled by a respective control knob 54. This outlet strip 5 has a plug hole at one side for the connection of the plug P of an extension wire.

As indicated, the present invention may be variously embodied. Recognizing that various modifications and changes are apparent, the scope herein shall be deemed as defined in the claims set hereinafter.

What is claimed is:

1. A 125 V/250 V safety electric socket device, comprising:

a socket body having a set of L pole contact metal plates and a set of N pole contact metal plates respectively connected to 125 V and 250 V power sources, a non-fuse circuit breaker contact metal rod, L-shaped rails defining a crossed sliding way;

a cover panel covered on said socket body, having a rectangular center opening, a leftward guide slot extended from said rectangular center opening, a downward guide slot extended from said rectangular center opening, and a circuit breaker slot, which receives said non-fuse circuit breaker contact metal rod;

a slide disposed between said socket body and said cover panel and moved in said crossed sliding way, said slide being marked with a 125 V directional arrow corresponding to said downward guide slot and a 250 V directional arrow corresponding to said leftward guide slot, and having two sets of bottom contacts for connection to 125 V and 250 V power sources respectively;

a first plug panel connected to said slide at one side corresponding to said 125 V directional arrow and disposed between said socket body and said cover panel, said first plug panel having plug holes for mounting a 125 V electric plug; and a second plug panel connected to said slide at one side corresponding to said 250 V directional arrow and disposed between said socket body and said cover panel, said second plug panel having plug holes for mounting a 250 V electric plug;

wherein when said slide is moved in the direction of said 250 V directional arrow, one set of bottom contacts of said slide are respectively electrically connected to said 250 V contact metal plates, permitting 250 V power source to be electrically connected to said socket body, and at the same time said first plug panel is moved into the operative position aligned with said rectangular center opening on said cover panel for receiving a 250 V electric plug; when said slide is moved to an OFF position with an OFF mark thereon shown through said rectangular opening on said cover panel, said first plug panel is moved out of said rectangular center opening on said cover panel, and when said slide is continuously moved in the direction of said 125 V directional arrow to carry said second plug panel into the operative position aimed at said rectangular center opening on said cover panel for receiving a 125 V electric plug, one set of bottom contacts of said slide are electrically connected to said 125 V contact metal plates, permitting 125 V power source to be electrically connected to said socket body.

2. A 125 V/250 V safety electric socket device comprised of an outlet strip, said outlet strip comprising a cover panel having two rows of outlets, a circuit board having 125 V and 250 V contact metal plates and being covered by said cover panel, a plug panel disposed between said cover panel and said circuit board and having an elongated toothed portion and two sets of bottom contacts, and a control knob mounted on said cover panel, a gear fixedly mounted on said control knob and meshed with said elongated toothed portion, wherein when said control knob is turned in one direction to move said plug panel leftward, a first set of bottom contacts of said plug panel are electrically connected to the respective contact metal plates on said circuit board, causing 125 V power source connected to individual socket bodies inside said outlet strip, and respective plug holes on said plug panel are aligned with said outlets for the connection of 125 V electric plugs; when said control knob is turned in the reversed direction to move said plug panel rightward, a second set of bottom contacts of said plug panel are electrically connected to the respective contact metal plates on said circuit board, causing 250 V power source connected to individual socket bodies inside said outlet strip, and respective plug holes on said plug panel are aligned with said outlets for the connection of 250 V electric plugs.

3. The 125 V/250 V safety electric socket device of claim 2 wherein said outlet strip comprises a first row of 125 V socket bodies and a second row of 250 V socket bodies for connection to 125 V and 250 V power sources respectively.

4. The 125 V/250 V safety electric socket device of claim 1 wherein the N or L pole of said socket body is comprised of two vertically spaced contact metal frames and matched with a set of contact spring plates to form a circuit breaker system; said socket body has a sliding contact pin supported on a spring so that when an electric plug is connected to said socket body, said sliding contact pin is forced backward to electrically connect the contact spring plates of said circuit breaker system; when the electric plug is spaced from said socket body at a distance over 0.5 cm, said sliding contact pin is forced away from said contact spring plates of said circuit breaker system to break the circuit.

5. The 125 V/250 V safety electric socket device of claim 4, wherein said socket body comprises L-shaped guide rails and guide grooves, a triangular retainer block supported on a spring, three slots, three contact metal frames respectively extended out of the slots, tilted metal spring plates respectively riveted to said contact metal frames, a plug plate detachably connected to said socket body, said plug plate comprising three prongs at one side, two rails at an opposite side, and a retaining hole through both sides, the rails of said plug plate being respectively inserted into said guide grooves and engaged with said guide rails, permitting said triangular retainer blocks to be forced into the retaining hole on said plug plate.

6. The 125 V/250 V safety electric socket device of claim 5 wherein said plug plate comprises a front panel, two angle prongs raised from said front panel for inserting into plug holes on said socket body, a square slot on said front panel, a control block received in said square slot and supported on a spring and having a beveled projection protruding said square slot, said beveled projection of said control block being forced back inside said square slot when said angle prongs are inserted into the plug holes on said socket body in the correct direction, said beveled projection being jammed in one plug hole on said socket body to prohibit an electric contact between said plug plate and said socket body when the poles of said angle prongs are not in match with the poles of the plug holes on said socket body.

* * * * *